US005736502A

United States Patent [19]

Wilkinson

[11] Patent Number: 5,736,502

[45] Date of Patent: Apr. 7, 1998

[54] PROCESS FOR PREPARING DETERGENT COMPOSITIONS

[75] Inventor: Carole Patricia Denise Wilkinson, Ixelles, Belgium

[73] Assignee: The Procter & Gamble Company, Cincinnati, Ohio

[21] Appl. No.: 605,127

[22] Filed: Mar. 5, 1996

[30] Foreign Application Priority Data

Sep. 7, 1993 [EP] European Pat. Off. ..... 93202607

[51] Int. Cl.[6] ..... C11D 11/00

[52] U.S. Cl. ..... 510/444; 510/361; 510/509; 510/510; 264/117; 264/140

[58] Field of Search ..... 510/444, 509, 510/510, 361; 264/117, 140

[56] References Cited

U.S. PATENT DOCUMENTS 5,133,924 7/1992 Appel et al. ..... 264/342 R
5,164,108 11/1992 Appel et al. ..... 252/174
5,282,996 2/1994 Appel et al. ..... 252/100

FOREIGN PATENT DOCUMENTS 0 340 013 A2 11/1989 European Pat. Off. ..... C11D 3/12
0339996 11/1989 European Pat. Off. .
0 390 251 B1 10/1990 European Pat. Off. ..... C11D 11/00
0 425 277 A2 5/1991 European Pat. Off. ..... C11D 17/06
04348196 12/1992 Japan .

*Primary Examiner*—Douglas J. McGinty
*Assistant Examiner*—Lorna M. Douyon
*Attorney, Agent, or Firm*—Ken K. Patel; Kim W. Zerby; Jacobus C. Rasser

[57] ABSTRACT

A process for preparing a granular detergent composition having a bulk density of at least 650 g/l comprises treating a spray-dried material in a high-speed mixer, adding water and hydratable compound to the spray dried material in a moderate-speed mixer, drying and/or cooling the product.

17 Claims, No Drawings

PROCESS FOR PREPARING DETERGENT COMPOSITIONS

FIELD OF THE INVENTION

The present invention relates to a process for preparing a granular detergent composition or a component of a granular detergent composition, in particular such a composition or component having a high bulk density.

BACKGROUND OF THE INVENTION

Conventionally, granular detergent compositions have been manufactured by spray-drying processes. In such processes, one or more detergent components, such as surfactants and builders, are mixed with water and the resultant slurry is heated and spray-dried in a tower. Such processes are described, for example, by A. Davidsohn, "Spray Drying and Dry Neutralisation of Powdered Detergents", *J. Am. Oil Chemists' Soc.*, Vol. 55, January 1978, pp. 134–140. Although the spray-dried granules so obtained may exhibit a good solubility, the product tends to have a low bulk density, and hence the packing volume is large.

There has been a recent trend in the detergents industry towards the manufacture of so-called concentrated or "compact" detergent powders, which typically have bulk densities of 600–650 g/l or higher. Although various processes for the production of detergent granules which do not require a spray-drying stage have been described in the literature, there is still a need for processes whereby products of high bulk density may be prepared by a spray-drying route. However, the scope for increasing the bulk density of the detergent product by adjusting the composition of the slurry fed to the spray-drying tower is limited and efforts have therefore been directed towards processes for the densification of spray-dried powders, i.e. the powders obtained from the spray-drying tower.

One process for the post-tower densification of spray-dried powders is described in EP-A-0,367,339 (Unilever) and its equivalent U.S. Pat. No. 5,133,924, which process comprises treating a spray-dried powder in a high-speed mixer/densifier, the mean residence time being from 5 to 30 seconds, the so-treated material then being treated in a moderate-speed granulator/densifier with a mean residence time of from 1 to 10 minutes, whereby the material is brought into, or maintained in, a deformable state (the powder being considered to be in a deformable state if its compression modulus is less than 25 MPa). The material obtained from the moderate-speed granulator/densifier is then subjected to drying and/or cooling so that it is no longer in a deformable state and is ready for use, handling and storage. However, this process may give rise to a product that contains a substantial quantity of fine particles (average size 350 μm) which, in turn, can cause poor dispensing of the product in automatic washing machines and also an undesirable level of gelling during usage. Moreover, the particles in the product may be soft and may cake easily in storage or under compression.

Disadvantages of the said process have also been disclosed in EP-A-0,390,251, which suggests that the process may be improved by adding 0.1 to 40% by weight of a powder, e.g. a fine zeolite powder, to the material in the moderate-speed granulator/densifier or to the material between that machine and the high-speed mixer/densifier. However, the addition of the zeolite may retard or prematurely inhibit the agglomeration process, leading to poor granule formation.

SUMMARY OF THE INVENTION

The present invention provides a process for preparing a granular detergent composition or component having a bulk density of at least 650 g/l, which process comprises treating a spray-dried material (which term includes herein spray-dried powder, granules or like particulate material) in a mixer, characterised in that water is added to and/or included in the spray-dried material, and in that the spray-dried material is treated in the said mixer in the presence of a hydratable compound and optionally of water.

The expression "in the presence of a hydratable compound and optionally of water" refers not only to a hydratable compound and water as such but also to a hydratable compound and/or water that have/has undergone at least partial reaction. Addition of further hydratable compound and/or of water downstream of the said mixer is not precluded.

DESCRIPTION OF EXEMPLARY EMBODIMENTS

The spray-dried material will comprise one or more ingredients suitable for use in or as a detergent composition; preferably, it will contain at least one surfactant and/or at least one builder.

Suitable surfactants may be selected from anionic, nonionic, ampholytic, zwitterionic and cationic surfactants and mixtures of two or more of such surfactants. Preferred spray-dried materials include those which contain at least one anionic surfactant, optionally in admixture with at least one nonionic surfactant.

Anionic surfactants include the water-soluble salts of higher (e.g. $C_8$–$C_{24}$) fatty acids; the water-soluble alkyl sulfates, especially those obtained by sulfating the higher (e.g. $C_8$–$C_{18}$) alcohols, such as those produced by reducing the glycerides of tallow or coconut oil; the water-soluble alkyl benzene sulfonates, especially those in which the alkyl group, which may have a straight or branched-chain configuration, has 9 to 20, preferably 9 to 15, carbon atoms; the water-soluble alkyl glyceryl ether sulfonates, especially those ethers of higher alcohols derived from tallow and coconut oil; the water-soluble fatty acid monoglyceride sulfonates and sulfates; the water-soluble alkyl phenol ethylene oxide ether sulfates containing from 1 to 10 units of ethylene oxide per molecule and wherein the alkyl groups contain 8 to 12 carbon atoms; the water-soluble alkyl ethylene oxide ether sulfates containing from 1 to 10 units of ethylene oxide per molecule and wherein the alkyl group contains 10 to 20 carbon atoms; the water-soluble salts of esters of alpha-sulfonated fatty acids containing 6 to 20 carbon atoms in the fatty acid group and 1 to 10 carbon atoms in the ester group; water-soluble salts of 2-acyloxy-alkane-1-sulfonic acids containing 2 to 9 carbon atoms in the acyl group and 9 to 23 carbon atoms in the alkane moiety; water-soluble alkyl ether sulfates containing from 10 to 20 carbon atoms in the alkyl group and 1 to 30 moles of ethylene oxide; water-soluble olefin sulfonates containing from 12 to 24 carbon atoms; and beta-alkyloxy alkane sulfonates containing 1 to 3 carbon atoms in the alkyl group and from 8 to 20 carbon atoms in the alkane moiety. Where appropriate, the term "alkyl" in the preceding list may include the alkyl portion of an acyl group. The water-soluble species may contain an alkali metal, ammonium, alkylammonium or alkylammonium counterion; the potassium and, more especially, the sodium salts are preferred.

Preferred anionic surfactants include the linear or branched-chain alkyl benzene sulfonates wherein the alkyl group has 10 to 16 carbon atoms, especially linear straight-chain alkyl benzene sulfonates in which the average number of carbon atoms in the alkyl group is from 11 to 13 (commonly abbreviated to $C_{11}$–$C_{13}$ LAS); alkyl sulfates having 10 to 18 carbon atoms in the alkyl group; and mixtures thereof.

Nonionic surfactants include the condensation products of alkyl phenols, especially those having a straight or branched-chain configuration and containing 6 to 16 carbon atoms, with alkylene oxide, especially with 4 to 25 moles of ethylene oxide per mole of alkyl phenol; the water-soluble condensation products of aliphatic alcohols, especially those containing 8 to 22 carbon atoms in a straight-chain or branched configuration (especially as an alkyl group containing 9 to 15 carbon atoms), with alkylene oxide, especially with 4 to 25 moles of ethylene oxide per mole of alcohol; and the condensation products of propylene glycol with ethylene oxide. Other nonionic surfactants include the alkyl polyglucosides.

Semi-polar nonionic surfactants include water-soluble amine oxides and phosphine oxides containing, in either case, one alkyl group of 10 to 18 carbon atoms and two groups selected from $C_1$–$C_3$ alkyl and $C_1$–$C_3$ hydroxyalkyl groups; and water-soluble sulfoxides containing one alkyl group of 10 to 18 carbon atoms and a $C_1$–$C_3$ alkyl or $C_1$–$C_3$ hydroxyalkyl group.

Ampholytic surfactants include derivatives of aliphatic secondary and tertiary amines and aliphatic derivatives of heterocyclic secondary and tertiary amines, in which in each case the aliphatic moiety can be either straight or branched-chain and in which one of the aliphatic substitutents contains 8 to 18 carbon atoms, at least one aliphatic substituent containing an anionic water-solubilising group, e.g. carboxy, sulfonate or sulfate.

Zwitterionic surfactants include derivatives of aliphatic quaternary ammonium, quaternary phosphonium and tertiary sulfonium compounds in which one of the aliphatic substituents contains 8 to 18 carbon atoms.

Useful cationic surfactants include water-soluble quaternary ammonium compounds of the general formula $$R^1R^2R^3R^4N^+X^-$$

wherein $R^1$ is alkyl having 10 to 20, preferably 12 to 18, carbon atoms and $R^2$, $R^3$ and $R^4$ are each independently an alkyl with 1 to 7 carbon atoms, preferably methyl; and $X^-$ is an anion, typically a halide and preferably chloride. Examples of such compounds include $C_{12}$–$C_{14}$ alkyl trimethylammonium chloride and cocoalkyl trimethylammonium methosulfate.

The spray-dried material may contain a detergent builder to assist in the control of mineral hardness, whether by precipitation, sequestration or ion exchange. Suitable builders may be selected from various water-soluble, alkali metal, ammonium or substituted (alkyl or alkylol) ammonium phosphates, polyphosphates (including tripolyphosphates, pyrophosphates and glassy polymeric metaphosphates), phosphonates, polyphosphonates, carbonates (including bicarbonates and sesquicarbonates), silicates, borates and polyhydroxysulfonates. The alkali metal, especially sodium, salts of these are preferred. Organic builders also come into consideration, such as polycarboxylates, for example citric acid and water-soluble salts thereof,succinates, oxydisuccinates, imidodisuccinates, ethylene diamine tetramethylene phosphonic acid or ethylene diamine tetraacetic acid.

A preferred class of builders comprises aluminosilicate ion-exchange materials. These may be crystalline or amorphous in structure and can be naturally occurring or synthetically derived. Suitable aluminosilicates are commercially available. Preferred synthetic crystalline aluminosilicate ion-exchange materials include the zeolites, e.g. zeolite A, zeolite P and zeolite X.

A further, optional component of the spray-dried materials may be selected from various organic polymers, some of which may also function as builders to improve detergency. Such polymers include sodium carboxy-lower alkyl celluloses, sodium lower alkyl celluloses and sodium hydroxy-lower alkyl celluloses, for example sodium carboxymethyl cellulose, sodium methyl cellulose and sodium hydroxypropyl cellulose, polyvinyl alcohols, polyacrylamides, polyacrylates and various copolymers such as those of maleic and acrylic acids.

Polymeric polycarboxylate builders include the water-soluble salts of homopolymers and copolymers of aliphatic carboxylic acids such as maleic, itaconic, mesaconic, fumaric, aconitic, citraconic and methylenemalonic acids.

The spray-dried material may optionally contain one or more neutral or alkaline, organic or inorganic salts which have a pH in solution of 7 or higher. These assist in providing the desired density and bulk to the detergent granules and, although some of the salts are inert, many may also function as a detergency builder in the laundering solution. Such salts include the alkali metal, ammonium or substituted (alkyl or alkylol) ammonium chlorides, fluorides and sulfates, for example sodium sulfate.

Other ingredients commonly used in detergent compositions include flow aids, colour speckles, bleaching agents and bleach activators, suds boosters or suds suppressors, antitarnish and anticorrosion agents, soil-suspending agents, soil-release agents, dyes, dye-transfer-inhibiting polymers (e.g. PVP), softening agents (e.g. kaolin particles as dry mixes), fillers, optical brighteners, germicides, pH-adjusting agents, nonbuilder alkalinity sources, hydrotropes, enzymes, enzyme-stabilising agents, chelating agents and perfumes. Numerous examples of such components as well as further examples of surfactants and builders will be found in the literature, for example International Patent Application WO92/22629, the teachings in which and in the references mentioned therein are incorporated herein by reference.

Desired ingredients that are not included in the spray-dried material (for example those which cannot be spray-dried on account of their heat sensitivity) may be added to the spray-dried material at any suitable stage after the spray tower; thus, for example, they may be added during the course of the process of this invention or they may be added to and mixed with, by methods known in the art, the densified granules obtained by the process of the present invention in order to obtain a finished product. It will be appreciated, however, that, depending upon their composition, the densified granules obtained by the present process may themselves constitute a serviceable detergent composition.

In accordance with the present invention, a hydratable compound is added to the spray-dried material. Preferred hydratable compounds are compounds, for example anhydrous compounds, capable of binding water, upon contact therewith at temperatures encountered in the process, in the molecule, in a crystal or in a clathrate or the like, but especially as water of crystallisation, to form a stable hydrate. Although such hydratable compounds as citric acid come into consideration, it is preferred to use a hydratable salt, e.g. an alkali metal carbonate, bicarbonate, (poly)

phosphate, citrate or sulfate. The most preferred hydratable salt is sodium carbonate. A commercial grade of anhydrous sodium carbonate is available as "soda ash". Other hydratable salts include sodium sulfate or, more preferably, sodium citrate (anhydrous), sodium bicarbonate or sodium tripolyphosphate. Mixtures of two or more hydratable compounds may also be used. The hydratable compound will generally have a fine particle size, the average particle size being usually from 0.1 to 250 μm, preferably from 1 to 100 μm. In principle, there is no upper limit on the amount of hydratable compound but it will usually be added in an amount of up to 35%, e.g. up to 30%, by weight of the dry matter in the spray-dried material. Normally, the amount of hydratable salt will be at least 5% by weight of the dry matter in the spray-dried material. Although the applicant does not wish to be bound by any hypothesis, it is believed that the hydratable compound provides hard seed particles that encourage particle growth in the spray-dried material by agglomeration. In contrast, any carbonate in the spray-dried material as obtained from the spray tower is not available for seeding and, because generally hydrated, for structuring the material.

In accordance with the present invention, water is also added to and/or included in the spray-dried material. The moisture content of spray-dried material as obtained from the tower is usually insufficient to achieve satisfactory results; accordingly, the present process is usually practised by adding water to the spray-dried material. Various orders of addition are possible: however, although the water may be added before, during and/or after the addition of the hydratable compound, it is preferred to add the water after the hydratable compound has been added to the spray-dried material, more preferably after the hydratable compound and spray-dried material have been thoroughly or intimately mixed together. Portionwise addition of the water at different stages of the present process is also possible. Also, it is to be noted that the water need not be supplied as such (e.g. as mains or tap water) but can be the aqueous component of a solution, dispersion, paste or other mixture, e.g. a silicate solution, a polymer solution or a surfactant paste. Normally, the amount of water in the system (i.e. the total of any water present in the spray-dried material as supplied to the present process and the water (if any) added to the spray-dried material during the present process) will be up to 30% by weight relative to the dry matter in the spray-dried material, e.g. up to 25%, preferably 10 to 25% and more preferably 10 to 20%. Typically, the amount of water added will be from 0 to 20%, e.g. 0 to 15%, and preferably from 2 to 15%, by weight of the dry matter in the spray-dried material.

The process of this invention may be carried out in a continuous or batchwise manner. In currently preferred embodiments of the invention, the spray-dried material is processed in a first mixer, which is generally a high-speed or moderate-speed mixer, preferably a high-speed mixer (which term herein includes a high-shear mixer), in which the spray-dried material will usually be ground and/or densified, and is subjected to further processing downstream of the first mixer, generally in order to promote agglomeration (which term includes granulation and the like) and, possibly, (further) densification. In these preferred embodiments, the material is conveyed from the first mixer into a second mixer in which the material generally undergoes agglomeration (or further agglomeration), thereby increasing the particle size and reducing or eliminating the content of fines. Although a rotating-drum apparatus comes into consideration, the second mixer is generally a high-speed or moderate-speed mixer, preferably a moderate-speed mixer (which term herein includes a moderate-shear mixer).

It may be mentioned here that the description of an apparatus herein as a "mixer" does not necessarily imply that an admixture is made to or blended with the spray-dried material in that apparatus; a "mixer" may possibly serve, in certain embodiments, just to agitate the material therein and effect, for example, particle-size reduction and/or densification or, as the case may be, particle-size increase, agglomeration, granulation and/or densification.

If the first mixer is coupled directly to the spray-drying process, "wet" spray-dried material, i.e. still containing a significant level of moisture, may be used; this reduces the drying load in the spray-drying tower, thereby increasing capacity. However, the material leaving the tower may alternatively be passed through one or more preliminary stages before entry into the first mixer.

A typical high-speed mixer will generally comprise a mixing chamber having a shaft mounted therein for rotation about its longitudinal axis, said shaft having a plurality of mixing elements (knives, blades, paddles or the like) mounted thereon. The speed of rotation of the shaft may be generally from 100 to 2500, preferably 600 to 2000, rpm (revolutions per minute). In addition to the shaft-mounted mixing elements, the mixer may also have separately mounted cutting or chopping devices. The residence time of the material in the high-speed mixer will depend upon a number of factors, including the rotational speed of the shaft, the position and the number of the mixing elements, the efficiency of the mixing elements at impelling the material through the mixer and the size of the outlet opening (which will normally be adjustable by means of a weir). In mixers, such as the Schugi (trade mark) granulator, in which the material falls vertically downwards through the machine, the residence time can be as low as one second; normally, the residence time in the high-speed mixer will not exceed one minute. The residence time of the material within a high-speed machine is typically from 5 to 30 seconds. (Residence times herein are, of course, "mean" residence times.)

Currently preferred are high-speed mixers from the Lödige (trade mark) CB range, e.g. the CB55, the CB40 or the CB30 recycler. In these, the mixing chamber is formed by a static hollow cylinder arranged with its axis horizontal or substantially horizontal and having a rotatable shaft mounted along its longitudinal axis. Other mixers also come into consideration, for example a Drais (trade mark) K-TTP80 mixer or a Littleford (trade mark) mixer, as do batch mixers, such as Eirich (trade mark) mixers operated a high speed.

A typical moderate-speed mixer will generally comprise a mixing chamber in which is mounted a rotatable shaft, on which shaft are mounted a plurality of mixing elements (knives, blades, paddles or the like). The speed of rotation of the shaft may generally be from 40 to 160, preferably from 60 to 150, rpm. In addition to the shaft-mounted mixing elements, the mixer may also comprise separately mounted cutting or chopping devices, which may be used to control the agglomeration process, for example to inhibit over-agglomeration. The residence time of the material in a moderate-speed mixer will depend upon a number of factors, including the rotational speed of the shaft, the position and the number of the mixing elements, the efficiency of the mixing elements at impelling the material through the mixer and the size of the outlet opening (which will normally be adjustable by means of a weir). Normally, the residence time will be from 1 to 10 minutes, preferably from 2 to 5 minutes.

Currently preferred are moderate-speed mixers from the Lödige (trade mark) KM range, also known as Lödige Ploughshare mixers, e.g. the KM 300, KM600, KM 3000 or KM 4200. In these, the mixing chamber is formed by a static hollow cylinder arranged with its axis horizontal or substantially horizontal and having a rotatable shaft mounted along its longitudinal axis, at least a proportion of the mixing elements that are mounted on the shaft usually having a generally ploughshare configuration. Other mixers also come into consideration, e.g. the Drais (trade mark) K-T 160. Moderate-speed mixers suitable for batch processing include Lödige FM mixers, Patterson Kelly (trade name) V blenders and Eirich mixers operated at lower speeds.

The material may be treated in the first mixer at any suitable temperature, e.g. from 15° C. to 50° C., more usually 20° C. to 40° C., e.g. 25° C. to 30° C. The material may be treated in the second mixer at any suitable temperature, e.g. from 25° C. to 80° C., more usually 35° C. to 60° C.

In certain preferred embodiments, the hydratable compound and the spray-dried material are thoroughly or intimately mixed together in the first mixer. In such embodiments, for instance, the hydratable compound may be added to the spray-dried material prior to entry into the first mixer or the spray-dried material and hydratable compound may be fed separately into the first mixer, for example through respective inlets in the mixer; when the process is carried out in a batchwise manner, it would, of course, be conceivable to add the spray-dried material and the hydratable compound sequentially through the same inlet. In such embodiments, the water may, for example, be added in either or both of the first mixer and the second mixer; preferably, the water is added to the mixture in the second mixer.

One or more additional substances may be added to the spray-dried material and/or the hydratable compound before or during the mixing thereof. For example, a nonionic surfactant may be added, typically in an amount of up to 15%, preferably up to 12%, e.g. 0.1–10%, by weight of the dry matter in the spray-dried material, as a binder in order to promote good agglomeration. It is, of course, also possible to include a nonionic surfactant in the spray-dried material itself or to add nonionic surfactant downstream of the first mixer, e.g. in the second mixer or by spraying it on during the admixing of the final ingredients to obtain the finished product.

In the present process, the addition of the water may be effected by spraying the water onto the spray-dried material or the mixture thereof with the hydratable compound, as the case may be; thus, the water may be sprayed through one or more (atomizing) spray-heads or nozzles, the resultant (fine) droplets of water being incorporated efficiently and thoroughly into particulate mass. Of course, the water can be added by other means; for example, it may be added via a pipe provided that it is adequately dispersed, e.g. by the blades or other elements of a mixing, cutting or chopping device. Although the applicant does not wish to be bound by any hypothesis, it is believed that the water will hydrate the dry hydratable compound, thereby generating heat which helps the agglomeration process to continue. Moreover, the hydration of the hydratable compound is believed to lead to solid bridging which further improves the structure of the granules. (Thus, the addition of the water to the hydratable compound before the latter is added to the spray-dried material, though not precluded, is not favoured, since it may lead to premature hydration of the hydratable compound.) Furthermore, the water improves the binding ability of any nonionic surfactant that may be present by making it very sticky; this helps to form strong agglomerates.

The spray-dried material obtained from the spray-drying tower may typically have a particle size in the range from 350 to 550 μm. After the first (usually high-speed or high-shear) mixing step or phase, the average particle size will generally be reduced, typically to a value of about 300 μm. On account of the agglomeration step or phase in the second mixer, the average particle size will typically be increased to a value of from 500 to 800 μm. The increase in particle size and a reduction in fines (particles less than 250 μm in size) are believed to be important factors in the dispensing improvements that can be achieved by means of this invention. In general, the product obtained by the present process should have a content of fines (<250 μm) of less than 10%, preferably less than 5%, by weight.

One or more further components may be added to the mixture between the first and second mixers and/or in the second mixer. For example, it may be advantageous to add further hydratable compound, preferably anhydrous sodium carbonate, to the mixture in the second mixer. It is also possible to add a fine powder, such as silica, calcium carbonate, talc or, preferably, aluminosilicate, e.g. zeolite, although it is preferred that the addition of this material be made, if at all, not earlier than half-way along, more preferably at least two-thirds of the way along, and most preferably at or near the end of, the second mixer or after agglomeration is substantially complete, so as to avoid or at least reduce any adverse effect on the agglomeration process. Such fine powders will typically have an average particle size of from 0.01 to 100 μm, preferably from 0.1 to 10 μm.

Yet another procedure involves deferring the addition of the hydratable compound until after the treatment of the spray-dried material in the first (usually high-speed) mixer; thus, it is possible to add the hydratable compound in the second mixer. In such cases, the water may be added in the second mixer and/or beforehand, e.g. in the first mixer. Portionwise addition of the hydratable compound at different stages of the present process is also possible.

A modification of the above-described two-step mixing (dual mixer) embodiments is to dispense with one of the mixers. Thus, the mixing of the hydratable compound and water with the spray-dried material can also be accomplished in a single mixer but sufficient energy should be supplied by the mixer to distribute and mix the hydratable compound and the water well with the spray-dried material in a single-step operation. Sufficient energy should also be imparted to the material to consolidate it into a denser form while it is in a deformable state. For these reasons it is preferred to employ a high-speed mixer; however, a moderate speed mixer can be used, although this will take longer.

Use may also be made of a variable speed batch mixer, such as the Eirich R09 mixer, by treating the material therein under high-speed conditions in a first step and then under moderate-speed conditions in a second step. The first and second steps in such an embodiment may be analogous to the first and second mixing steps in the dual mixer embodiments.

The agglomerated, or granular, material obtained after the treatment in the mixer(s) and the addition (if any) of water may be subjected to drying and/or forced cooling, for example in one or more fluidised-bed apparatuses. The fluidised-bed treatment may also be carried out for the purpose of ageing the agglomerates or granules in order to accelerate hydration therein.

The agglomerated or granular material may, if appropriate after drying and/or cooling, have one or more further components admixed thereto in order to prepare a finished detergent powder product. Thus, for example, further liquid material, such as perfume, liquid suds-suppressor or nonionic surfactant, can be sprayed on in a mix drum.

The granular material obtained by the process of the present invention generally contains little or no fines and therefore contributes to the aesthetics of the finished product, which will not appear dusty. Moreover, the detergent granules so obtained have been found to have excellent dispensing and solubility characteristics and to have a reduced tendency to cake upon storage.

The present invention is illustrated in and by the following examples, in which parts and percentages are by weight unless otherwise stated.

EXAMPLE 1

Spray-dried detergent powders were made according to the following composition:

| | Composition (Parts) | |
|---|---|---|
| | a | b |
| Linear Alkyl Benzene Sulfonate | 15.2 | 15.2 |
| Zeolite A | 24.0 | 24.0 |
| Polyacrylate Polymer | 5.0 | 5.0 |
| Chelating Agent | 0.3 | 0.3 |
| Carboxy Methyl Cellulose | 0.4 | 0.4 |
| Fluorescent Brightener | 0.1 | 0.1 |
| Sodium Carbonate | 15.0 | 5.0 |
| Moisture | 4.0 | 3.0 |

The detergent powder (a) was mixed with 5 parts of nonionic surfactant in a high shear mixer, a Lödige CB30. This product was then passed to a second, moderate speed mixer, a Lödige KM600, wherein it was mixed with 4 parts of zeolite A which were fed into the front end of the mixer.

The detergent powder (b) was mixed with 5 parts of nonionic surfactant in a high shear mixer, a Lödige CB30. The product was passed to a second, moderate-speed mixer, a Lödige KM600, wherein it was mixed with 10 parts anhydrous sodium carbonate. 5 parts of water were added by spraying the water through a pressure nozzle. 4 parts of zeolite A were added at the rear end of the second mixer.

The following operating conditions for the mixers were employed in the processing of both powders: the Lödige CB30 was operated with a shaft speed of 2000 r.p.m., the material therein having a residence time of 20 seconds and attaining a temperature of 20° C., whereas the Lödige KM600 was operated at 200 r.p.m., the material therein having a residence time of 4 minutes and attaining a temperature of 45° C.

The resulting detergent granules were dried for 2 minutes at 80° C. in a fluidized bed to a moisture content of 4 parts. The material was then cooled down to 20° C. in a fluidised bed over a period of 2 minutes. The average particle size of the resultant product (a) was 300 μm, whereas the average particle size of the resultant product (b) was 600 μm.

The products from both tests were each mixed with other detergent components in a rotating drum according to the following compositions (parts):

| Product | A | B |
|---|---|---|
| Detergent Granules (a) | 70 | — |
| Detergent Granules (b) | — | 70 |
| Sodium Perborate Monohydrate | 16 | 16 |
| TAED | 5 | 5 |
| Sodium Silicate 2R | 5 | 5 |
| Protease Enzyme | 1 | 1 |

-continued

| Product | A | B |
|---|---|---|
| Lipase Enzyme | 0.2 | 0.2 |
| Perfume | 0.3 | 0.3 |
| Suds Suppressor | 0.5 | 0.5 |
| Nonionic Surfactant $C_{25}AE_3$ | 1.0 | 1.0 |

The products had identical compositions, but product (A), which had a bulk density of 820 g/l, had an average particle size of 350 μm (with a fines content (<250 μm) of about 20% by weight), whereas product (B), which had a bulk density 820 g/l, had an average particle size of 580 μm (with a fines content (<250 μm) of below 5% by weight).

The two products were tested in a washing machine dispenser using the following procedure. 100 g of each product were placed in the drawer of a washing machine dispenser and water was added at 2 liter/min for 2 minutes. At the end of each test, the washing machine drawer dispenser was removed and the amount of residue weighed. The residual material was expressed as a percentage of the original dry matter.

The following result was obtained:

| | Residue (%) | |
|---|---|---|
| Machine/Product | A | B |
| Zanussi (trade name) | 90 | 5 |

EXAMPLE 2

A spray dried detergent powder was produced according the following composition:

| | Parts |
|---|---|
| Linear Alkyl Benzene Sulfonate | 18 |
| Alkyl Polyglucoside | 3 |
| Sodium Tripolyphosphate | 20 |
| Sodium Silicate 1.6 R | 8 |
| Sodium Polyacrylate Polymer | 6 |
| Chelating Agent | 0.2 |
| Moisture | 4 |

The spray-dried powder was mixed with 10 parts of anhydrous sodium tripolyphosphate in a variable speed Eirich R09 mixer for 10 seconds; in this step the mixer was operated with a speed of 1000 r.p.m., the material therein attaining a temperature of 40° C. 5 parts of water were added to the mixer and mixed for 30 seconds; in this step the mixer was operated with a speed of 200 r.p.m., the material therein attaining a temperature of 55° C. The product (densified detergent granules) was then removed and mixed in a rotating drum with other detergent ingredients to form a finished product of the following composition:

| | Parts |
|---|---|
| Densified Detergent Granules | 74 |
| Sodium Bicarbonate | 10 |
| Sodium Citrate Dihydrate | 10.8 |
| Savinase ™ Enzyme | 1.0 |
| Cellulase Enzyme | 0.2 |
| Lipase Enzyme | 0.4 |

-continued

| | Parts |
|---|---|
| Perfume | 0.4 |
| Polyvinyl Pyrrolidone | 0.5 |
| Nonionic Surfactant | 2.0 |
| Suds Supressing Agent | 0.5 |

The average particle size of the product, which had a bulk density 780 g/l, was 500 μm (with a fines content (<250 μm) of below 5% by weight). 100 g of the product were placed in the dispensing drawer of a washing machine. Water was added at 2 liter/min for 2 minutes at 20° C. and the following results were obtained:

| Machine | Residue (%) |
|---|---|
| Zanussi (trade name) | 0 |

EXAMPLE 3

A spray-dried detergent powder was produced according the following composition:

| | Parts |
|---|---|
| Tallow Alcohol Sulfate | 3 |
| Linear Alkyl Benzene Sulfonate | 12 |
| Zeolite A | 26 |
| Sodium Carbonate | 5 |
| Fluorescent Brightener | 0.1 |
| Moisture | 4 |

The spray-dried powder was added into a continuous Lödige CB40 mixer, into which 5 parts of sodium bicarbonate, 5 parts of anhydrous citrate and 6 parts of polyacrylate polymer solution (40%) were also added. The Lödige CB40 was operated at 1000 r.p.m., the material therein having a residence time of 30 seconds and attaining a temperature of 30° C. The resulting mixture was passed to a second mixer, a Lödige KM4200, where it was allowed to agglomerate. The Lödige KM400 was operated at 80 r.p.m., the material therein having a residence time of 3 minutes and attaining a temperature of 50° C. The product leaving the Lödige KM4200 mixer was passed to a fluidized bed drier, where it was dried for 2 minutes at 80° C. to a moisture content of 4 parts. The material was then cooled down to 20° C. in a fluidised bed over a period of 2 minutes. The product (densified detergent granules) was then mixed with other ingredients in a rotating drum to form a finished product according to the following composition:

| | Parts |
|---|---|
| Densified Detergent Granules | 60.1 |
| Sodium Percarbonate | 15.0 |
| Layered Silicate Granules | 10.0 |
| Bleach Activator, TAED | 5.0 |
| Protease Enzyme | 1.4 |
| Suds Suppressor Granules | 1.5 |
| Alcohol Ethoxylate $C_{25}E_3$ | 5 |
| Perfume | 0.5 |
| Soil Release Polymer | 0.3 |
| Detergent Speckle | 1.0 |
| Lipase Enzyme | 0.2 |

The average particle size of the product, which had a bulk density 850 g/l, was 640 μm (with a fines content (<250 μm) of below 5% by weight). The product was tested in a washing machine dispenser at 2 liters/min for 2 minutes at 20° C., and the following result was obtained:

| Machine | Residue (%) |
|---|---|
| Zanussi | 2 |

Dispensing benefits comparable to those noted in Examples 1, 2 and 3 were observed when using washing machines supplied by other washing-machine manufacturers.

EXAMPLE 4

A spray-dried detergent powder was made according to the following composition (parts):

| | |
|---|---|
| Linear Alkyl Benzene Sulfonate | 8.40 |
| Polymer | 3.90 |
| Sodium Sulfate | 12.83 |
| Sodium Silicate | 2.6 |
| Chelating Agent | 0.4 |
| Zeolite | 9.7 |
| Fluorescent Brightener | 0.17 |
| Nonionic Surfactant | 9.0 |
| Moisture | 6.0 |

The spray-dried powder was mixed with 10 parts of sodium carbonate in a high-speed mixer, a Lödige CB30. The product was then passed to a second, moderate speed mixer, a Lödige KM600 where 2 parts of water were added by spraying the water through a pressure nozzle.

The following operating conditions were employed in the processing of the powder. The Lödige CB30 was operated at a shaft speed of 1500 rpm, the material therein having a residence time of 25 seconds, and attaining a temperature of 25° C. The Lödige KM600 was operated at 200 rpm, the material therein having a residence time of 5 minutes and attaining a temperature of 50° C.

The resulting detergent granules were dried for 2 minutes at 80° C. in a fluidised bed to a moisture content of 4 parts. The material was then cooled down to 20° C. in a fluidised bed for 2 minutes. The average particle size was 650 μm.

The product was mixed with other detergent components in a rotating drum according to the following composition (parts):

| | |
|---|---|
| Detergent granules | 61.0 |
| Soap flakes | 3.00 |
| Coconut alkyl sulphate extrudates | 6.80 |
| Suds supressor particles | 0.50 |
| Perborate monohydrate | 18.0 |
| TAED | 7.00 |
| Protease Enzyme | 0.30 |
| Savinase Enzyme | 3.00 |
| Perfume | 0.40 |

The finished product had a bulk density of 800 g/l and an average particle size of 600 μm (with a content of fines (<250 μm) of below 5% by weight).

It will of course be understood that the present invention has been described above purely by way of example and that modifications of detail can be made within the scope of the invention.

I claim:

1. A process for preparing a granular detergent composition having a bulk density of at least 650 g/l, which process comprises the steps of:

a) providing a spray dried mixture comprising water and dry detergent ingredients selected from the group consisting of surfactants, detergent builders and mixtures thereof;

b) mixing the spray dried mixture for a first period of time in a mixer having a mixing chamber containing a rotatable shaft on which a plurality of mixing elements are mounted and wherein the shaft rotates at a speed of from 600 to 2500 rpm during the first period of time;

c) mixing the spray dried mixture for a second period of time in a mixer having a mixing chamber containing a rotatable shaft on which a plurality of mixing elements are mounted, wherein the shaft rotates at a speed of from 40 to not greater than 200 rpm during the second period of time, and adding to the mixture, before the completion of the second period of time, water and a hydratable compound selected from the group consisting of alkali metal salts of carbonate, bicarbonate, phosphate, polyphosphate, citrate, sulfate, and mixtures thereof, wherein the amount of water added is from 2% to 25% by weight of the dry detergent ingredients and the hydratable compound is a fine powder having a mean particle size of from 0.1 to 250 μm; and d) subjecting the composition resulting from step c) to at least one of drying and cooling.

2. The process according to claim 1, wherein the amount of hydratable compound added in step c) is from 5% to 35% by weight of the dry detergent ingredients.

3. The process according to claim 1, wherein the amount of water added in step c) is from 10% to 20% by weight of the dry detergent ingredients.

4. The process according to claim 1, wherein the first period of time is from five to thirty seconds.

5. The process according to claim 1, wherein the second period of time is from one to ten minutes.

6. The process according to claim 1, wherein during the mixing of step b), water and a hydratable compound selected from the group consisting of alkali metal salts of carbonate, bicarbonate, phosphate, polyphosphate, citrate, sulfate, and mixtures thereof are added to the spray dried mixture.

7. The process according to claim 1, wherein less than 10% by weight of the granular detergent composition has a particle size of less than 250 μm.

8. The process according to claim 1, wherein less than 5% by weight of the granular detergent composition has a particle 2 of less than 250 μm.

9. The process according to claim 1, wherein the spray dried mixture comprises at least one of an anionic and a non-ionic surfactant.

10. The process according to claim 1, wherein the hydratable compound is added as a fine powder having a mean particle size of from 1.0 to 100 μm.

11. The process according to claim 1, wherein the temperature of the spray dried mixture during the first period of time is from 15° C. to 50° C.

12. The process according to claim 1, wherein during the second period of time the contents of the mixing chamber are maintained at a temperature of from 25° C. to 80° C.

13. The process according to claim 1, wherein during the second period of time the contents of the mixing chamber are maintained at a temperature of from 35° C. to 60° C.

14. The process according to claim 1, wherein the water is added to the mixture in step c) through an atomizer.

15. The process according to claim 1, wherein the granular detergent composition has a mean particle size of from 500 to 800 μm.

16. The process according to claim 1, wherein the hydratable compound in step c) is anhydrous.

17. The process according to claim 1 wherein the mixing for a first period of time is carded out in a first mixer and the mixing for the second period of time is carried out in a second mixer.

* * * * *